US009051907B2

(12) United States Patent
Wakabayashi et al.

(10) Patent No.: US 9,051,907 B2
(45) Date of Patent: Jun. 9, 2015

(54) VEHICLE FUEL SUPPLY DEVICE

(75) Inventors: Shinichi Wakabayashi, Wako (JP); Yuichi Kato, Wako (JP); Shigeru Kita, Wako (JP); Tomoyuki Okamoto, Wako (JP); Masaya Adachi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 944 days.

(21) Appl. No.: 13/227,501

(22) Filed: Sep. 8, 2011

(65) Prior Publication Data

US 2012/0060799 A1 Mar. 15, 2012

(30) Foreign Application Priority Data

Sep. 10, 2010 (JP) ..... 2010-202686

(51) Int. Cl.

| | |
|---|---|
| ***F02M 37/04*** | (2006.01) |
| ***F02M 37/10*** | (2006.01) |
| ***F02M 37/00*** | (2006.01) |
| ***F02M 37/20*** | (2006.01) |
| ***F02M 37/22*** | (2006.01) |
| *F02B 61/02* | (2006.01) |

(52) U.S. Cl.

CPC ..... *F02M 37/103* (2013.01); *F02B 61/02* (2013.01); *F02M 37/007* (2013.01); *F02M 37/20* (2013.01); *F02M 37/22* (2013.01)

(58) Field of Classification Search

CPC . F02M 55/02; F02M 37/0058; F02M 37/103; F02M 37/007; F02M 37/20; F02M 37/22

USPC ..... 123/509, 514; 137/565.17, 565.34, 574

See application file for complete search history.

(56) References Cited

U.S. PATENT DOCUMENTS

| | | | | |
|---|---|---|---|---|
| 6,182,640 | B1 * | 2/2001 | Nakashima et al. | 123/516 |
| 7,644,703 | B2 * | 1/2010 | Fujita | 123/509 |
| 2005/0201877 | A1 * | 9/2005 | Mitsudou | 417/423.14 |
| 2007/0215122 | A1 * | 9/2007 | Nakagawa et al. | 123/509 |
| 2009/0007527 | A1 * | 1/2009 | Mitsudou | 55/290 |
| 2009/0184118 | A1 * | 7/2009 | Kobayashi et al. | 220/62.22 |
| 2009/0242300 | A1 * | 10/2009 | Mizukura et al. | 180/69.4 |
| 2010/0059024 | A1 * | 3/2010 | Yamada et al. | 123/495 |

FOREIGN PATENT DOCUMENTS

| | | | | |
|---|---|---|---|---|
| JP | S61-194766 | U | | 12/1986 |
| JP | Sho 61-194766 | | | 12/1986 |
| JP | 2008075528 | A | * | 4/2008 |
| JP | 2008-128191 | A | | 6/2008 |
| JP | 2008128191 | A | * | 6/2008 |
| JP | 2010-174895 | A | | 8/2010 |

* cited by examiner

*Primary Examiner* — Hieu T Vo
*Assistant Examiner* — Arnold Castro
(74) *Attorney, Agent, or Firm* — Squire Patton Boggs (US) LLP

(57) ABSTRACT

In an upright state where a vehicle is supported by a main stand, or and a tilted state where the vehicle is supported by a side stand, an inflow port of a fuel filter unit is located at a position higher than an outflow port. The fuel filter unit and the upstream side filter pipe are installed in the vehicle so that the upstream side filter pipe is arranged at a higher position as it goes toward the upstream side.

19 Claims, 15 Drawing Sheets

VEHICLE FUEL SUPPLY DEVICE

BACKGROUND

1. Field

The present invention relates generally to a vehicle fuel supply device and in particular to a fuel supply device that is configured to improve air-bleeding and/or vapor-healing performance in a fuel filter installed therein.

2. Description of Related Art

For highly-volatile fuel, the fuel in a fuel filter vaporizes during the stoppage of a vehicle: in other words, vapor occurs in the fuel filter. Fuel is fed under its own weight from a fuel tank to the fuel filter. If the inlet of a filter case is blocked by the vapor, therefore, the fuel cannot be fed to the fuel filter. In the past, a gas-bleeding pipe has been installed on a lateral surface of the filter case to return the vapor in the filter case into the fuel tank, as described for example in Japanese Utility Model Laid-Open No. Sho 61-194766 (Patent Document 1). This makes the configuration complicated.

SUMMARY

Embodiments of the present invention can provide a fuel supply device adapted to return vapor to a fuel tank without the provision of a vapor-return-dedicated pipe.

In a first embodiment, the invention relates to a fuel supply device for a vehicle, by including a fuel tank supported by a vehicle frame of a vehicle, and storing fuel. A fuel pump unit can be mounted from below to block an opening of a bottom plate of the fuel tank. A fuel pump can be installed in the fuel tank to constitute part of the fuel pump unit, and to supply under pressure fuel to a fuel injector of an engine. An upstream side filter pipe is disposed below the fuel tank, and communicates with the inside of the fuel tank. A downstream side filter pipe can be coupled to the fuel pump (37). A fuel filter unit can be connected between the upstream side filter pipe and the downstream side filter pipe and can filter fuel fed from the fuel tank) to the fuel pump. The fuel filter unit can be provided with a filter case; (the filter case can have, on one end side, an inflow port into which fuel fed from the fuel tank via the upstream side filter pipe (flows, and on the other side, the filter can have with an outflow port adapted to deliver fuel to the fuel pump via the downstream side filter pipe. A filter element is housed between the inflow port and the outflow port. When the vehicle is in an upright state, the inflow port of the fuel filter unit is disposed at a position higher than the outflow port, and the upstream side filter pipe is arranged at a higher position as the upstream side filter pipe goes toward the upstream side.

In a second embodiment, the fuel supply device can be configured such that when the vehicle is stopped and supported by a side stand, the inflow port of the fuel filter unit is located at a position higher than the outflow port, and the upstream side filter pipe is arranged at a higher position as the upstream side filter pipe goes toward the upstream side.

In a third embodiment, the fuel supply device can be configured such that an upstream end of the upstream side filter pipe is disposed on the same side as the side stand.

In a fourth embodiment, the fuel supply device can be configured such that even when the vehicle is stopped and supported by any one of the main stand and the side stand, the downstream side pipe is arranged to extend upward from the outflow port of the fuel filter unit.

In a fifth embodiment, a fuel temporary reservoir portion communicating with the inside of the fuel tank is installed at a lower portion of the fuel pump unit. A fuel sucking-out pipe is connected with the upstream side filter pipe is installed on the fuel temporary reservoir portion. When the vehicle is supported by any one of the main stand and the side stand, the fuel sucking-out pipe is installed at a position rearward of and below the fuel temporary reservoir portion and on the same side (the left side) as the side stand.

In a sixth embodiment, the fuel filter unit can be installed with a longitudinal direction thereof made vertical so that the inflow port is disposed upward and the outflow is disposed downward.

In a seventh embodiment, a lateral-surface upper portion of the fuel filter unit can be formed with the inflow port and the fuel filter unit can be formed with the outflow port on one end side.

In an eighth embodiment, the fuel of the vehicle is gasoline, alcohol, or a mixture of gasoline and alcohol, and fuel injection is controlled in accordance with the proportion of gasoline to alcohol.

In the first embodiment, in the case where fuel does not flow in the pipe when the vehicle is stopped and supported by the main stand, the vapor occurring in the fuel filter unit can be moved toward the inflow port of the fuel filter unit and returned from the inflow port to the fuel tank via the upstream side filter pipe. Therefore, the vapor lock in the fuel filter unit can be prevented without the additional provision of a vapor-return-dedicated pipe continuous with the lateral-surface upper portion of the fuel filter unit.

In the second embodiment, even when the vehicle is stopped and supported by the side stand and the vehicle body is tilted, the effect of the first embodiment can be continued. Therefore, the vapor lock in the fuel filter unit can be prevented.

In the third embodiment, even when the vehicle is stopped and is supported by the side stand (71) so that the vehicle body is tilted, fuel easily flows into the upstream side filter pipe. Therefore, fuel can effectively be utilized.

In the fourth embodiment, even when the vehicle is stopped and supported by the side stand, the vapor on the clean side in the fuel filter unit can be easily bled toward the fuel pump.

In the fifth embodiment, even when the vehicle is supported by any one of the main stand and the side stand, the fuel sucking-out pipe of the fuel temporary reservoir portion is located at a low position. Therefore, fuel supply can be smooth and vapor-bleeding can be made satisfactory.

In the sixth embodiment, the vapor on the clean side (the outflow port side) of the fuel filter unit becomes easy to be bled toward the dirty side (the inflow port side). Therefore, vapor-bleeding can be enabled further effectively.

In the seventh embodiment, the air-bleeding performance on the inflow port and on the outflow port can be made satisfactory.

In the eight embodiment, even if fuel newly fed into the fuel tank is different in type and in alcohol concentration from the fuel remaining in the fuel tank, the filter case functions as a sub-tank so that the new and old fuels are mixed with each other in the filter case. Therefore, a variation in the alcohol concentration in the fuel fed to the fuel injector of the engine can be reduced. Thus, appropriate fuel injection control according to the proportion of gasoline to alcohol can be enabled to improve start-up performance and traveling performance.

DETAILED DESCRIPTION

Figure 1:
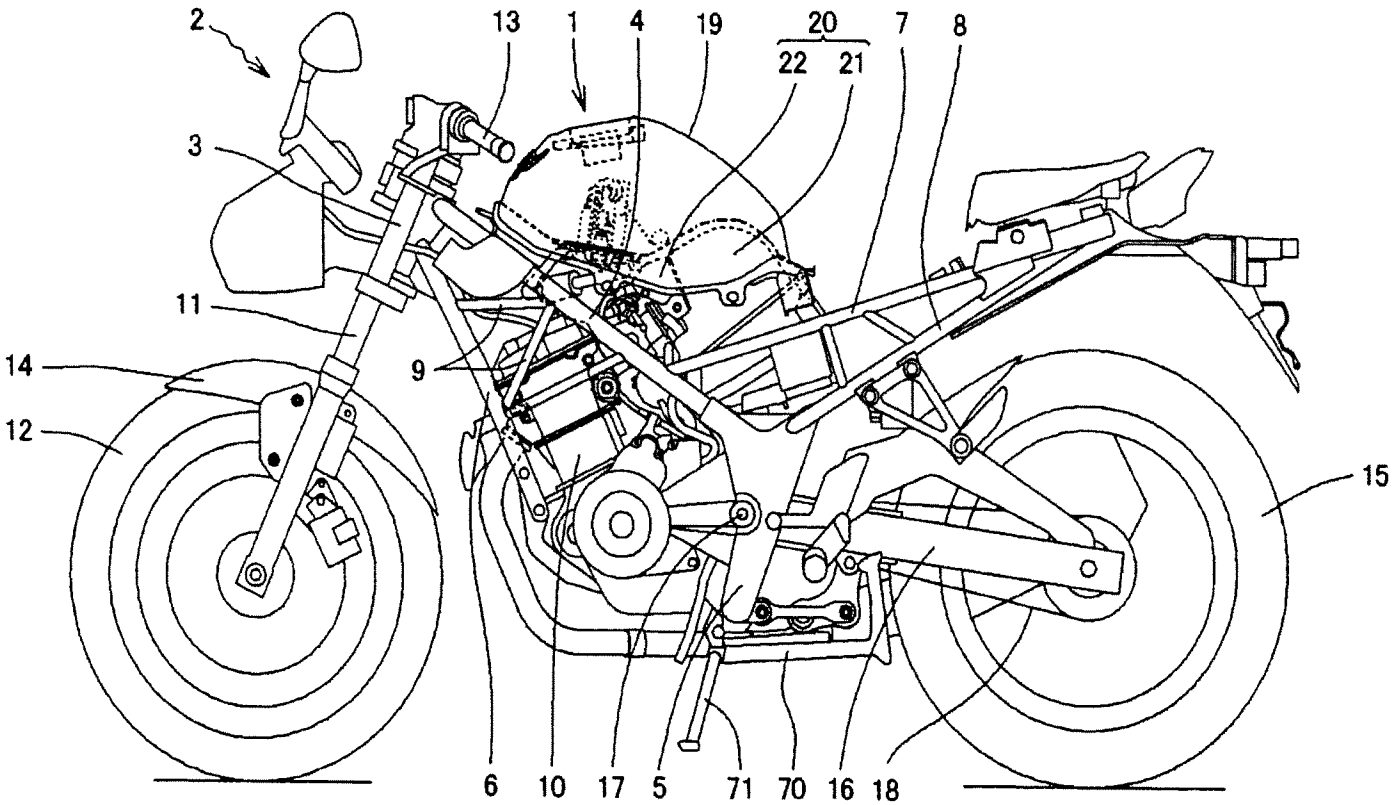
FIG. 1 is a lateral view of a motorcycle on which a fuel supply device according to an embodiment of the present invention is mounted.

FIG. 1 is a lateral view of a motorcycle 2 on which a fuel supply device 1 according to an embodiment of the present invention is mounted. FIG. 1 illustrates a state where a body cover, a seat, etc., are removed. A major frame of the motorcycle 2 can include a head pipe 3 in a front portion of the vehicle, a pair of left and right main frames 4 extending rearward downward from the head pipe 3, and a pair of left and right pivot plates 5 connected to the corresponding main frames 4. The major frame can further include a down frame 6 extending downward from the head pipe 3, a pair of left and right rear frames 7 connected at one ends thereof to corresponding intermediate portions of the main frames 4 and extending rearward upward, and a support frame 8 extending rearward from the pivot plates 5 and connected to rear portions of the rear frames 7. Several thin reinforcing frames 9 can be installed between the corresponding frames mentioned above. The down frame 6 is connected to the pivot plates 5 via an engine 10.

A front fork 11 is turnably supported by the head pipe 3. A front wheel 12 is rotatably supported by the lower end of the front fork 11. A steering handlebar 13 is connected to the upper portion of the front fork 11. A front fender 14 is supported by an intermediate portion of the front fork 11 so as to cover above the front wheel. A pair of left and right rear forks 16 supporting a rear wheel 15 is vertically swingably supported by the pivot plates 5 via a pivot shaft 17. The drive force of the engine 10 can be transmitted to the rear wheel 15 via a chain 18, or other suitable mechanism.

In this example, the engine 10 is suspension-supported by the main frames 4 and the down frame 6 and supported at a lower portion and a rear portion by a lower portion of the down frame 6 and the pivot plates 5. A fuel tank 19 is installed above the engine 10 and supported by the main frames 4 and the rear frames 7. An air cleaner 21 and a resonator 22, which form an intake system chamber 20, are installed below the rear portion of the fuel tank 19. A main stand 70 and a side stand 71 are installed at the lower portion of the vehicle body.

Figure 2:
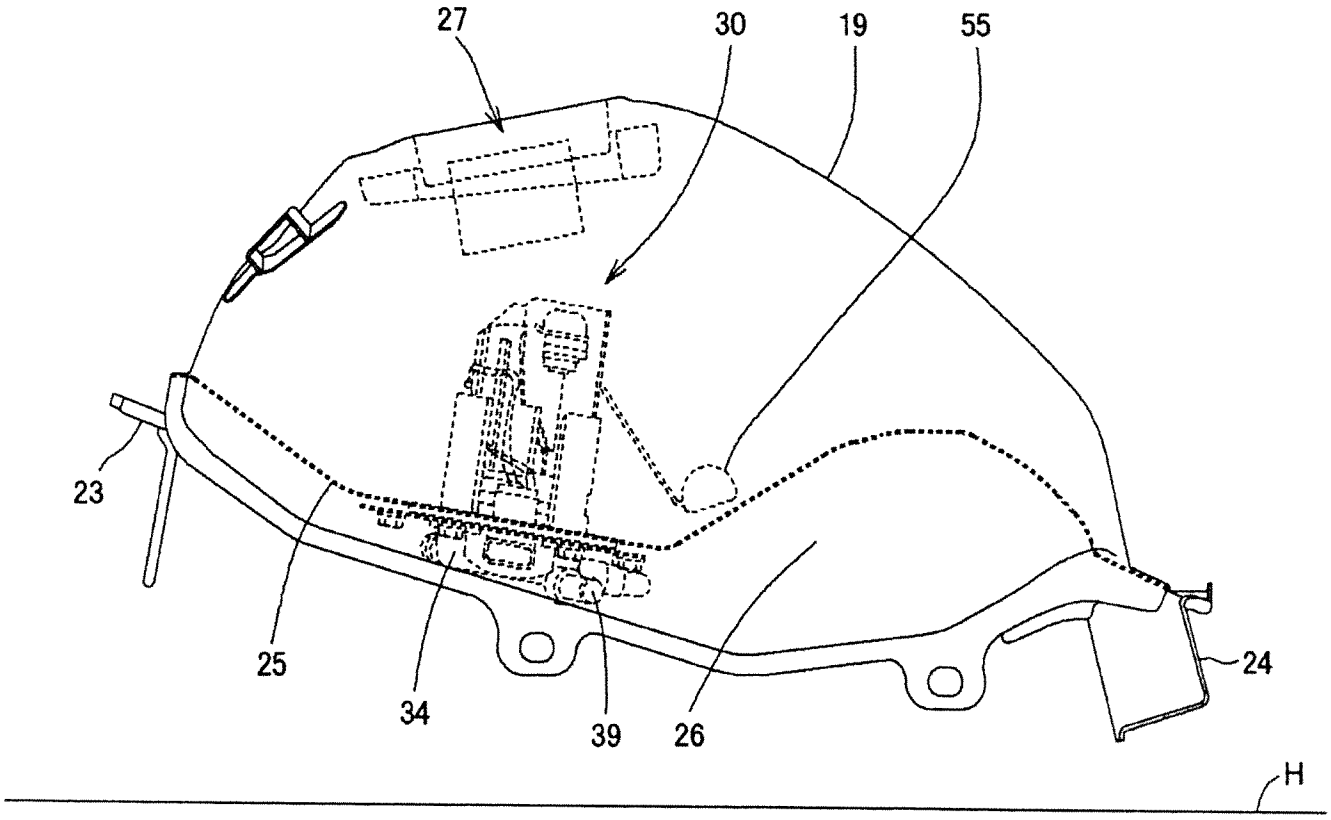
FIG. 2 is a left lateral view of a fuel tank.

FIG. 2 is a left lateral view of the fuel tank 19 in a posture taken when the motorcycle 2 is supported by the main stand 70. Symbol "H" denotes a horizontal plane. An attachment portion 23 used to attach the fuel tank 19 to the main frames 4 is provided at a front portion of the fuel tank 19. In addition, an attachment portion 24 used to attach the fuel tank 19 to the rear frames 7 is provided at a rear portion of the fuel tank 19. A tank bottom plate 25 is curvedly installed in the fuel tank 19. A rear lower surface of the tank bottom plate 25 is formed as a recess portion 26 facing the downside. The air cleaner 21 and the resonator 22 are located in the recess portion 26. A fuel filling port 27 is installed in an upper portion of the fuel tank 19. A fuel pump unit 30 is installed in the fuel tank 19. The fuel pump unit 30 is mounted to the tank bottom plate 25 at its lower portion.

Figure 3:
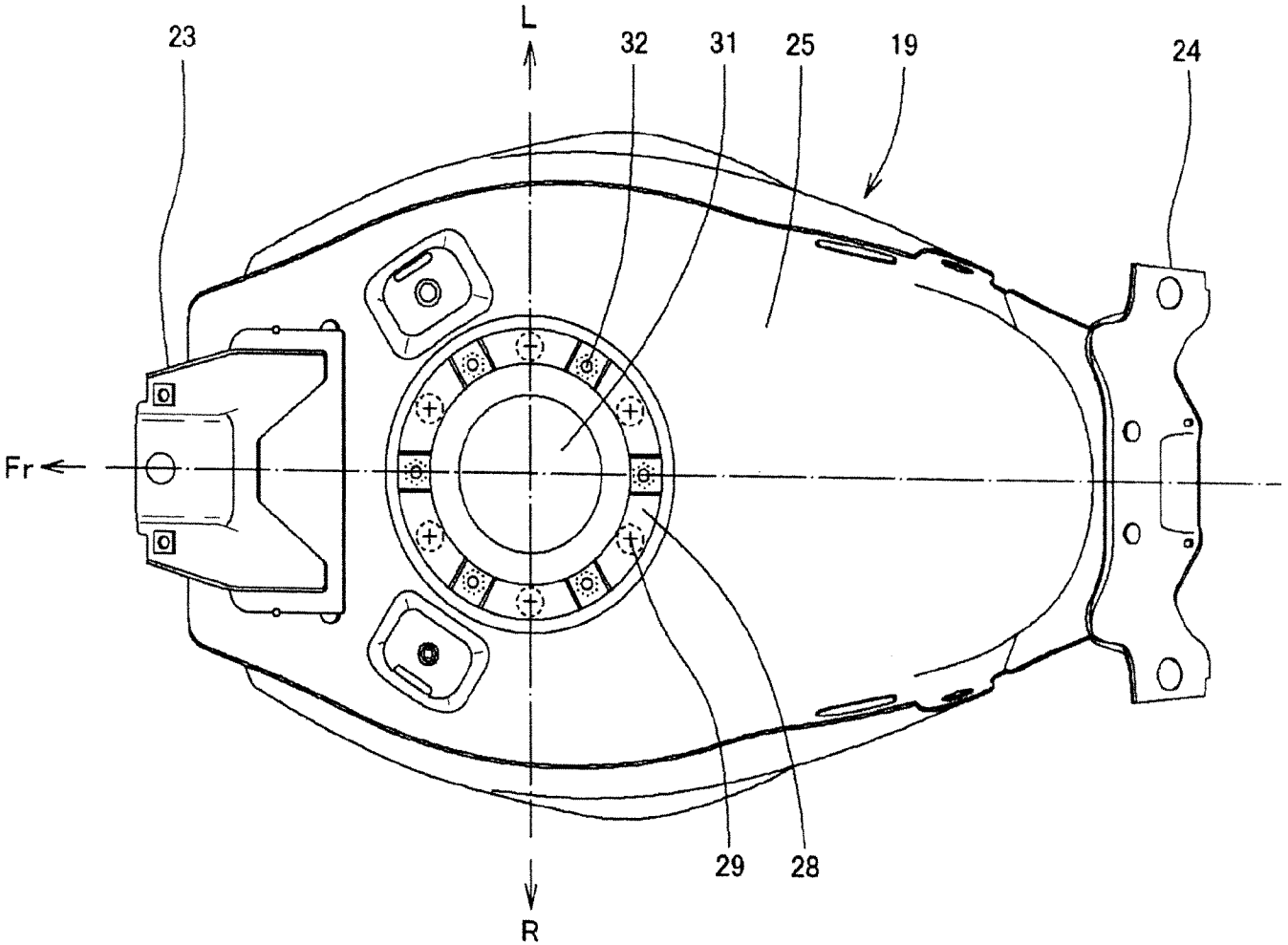
FIG. 3 is a bottom view of the fuel tank.

FIG. 3 is a bottom view of the fuel tank 19. Arrows "Fr," "R" and "L" denote the front, right and left, respectively, of each member corresponding to the front, right and left of the vehicle. A circular opening is provided in a front-half portion of the tank bottom plate 25 of the fuel tank 19. This opening is a fuel pump unit insertion hole 31 used to insert the fuel pump unit 30 therethrough from below, for mounting. The tank bottom plate 25 on the circumferential portion of the fuel pump unit insertion hole 31 is formed as a flat surface portion. A ring-like member 28 holding a plurality of bolts 32 is attached to the flat surface portion by spot welding 29. The plurality of bolts 32 are used to mount the fuel pump unit 30.

Figure 4:
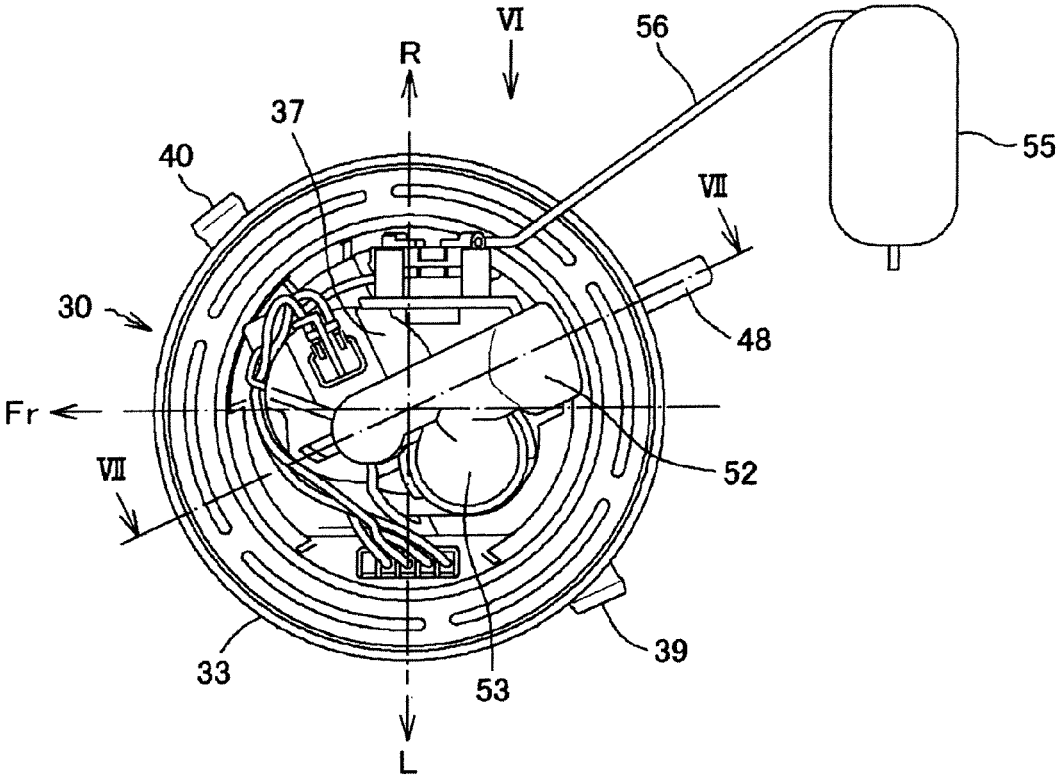
FIG. 4 is a plan view of a fuel pump unit.
Figure 5:
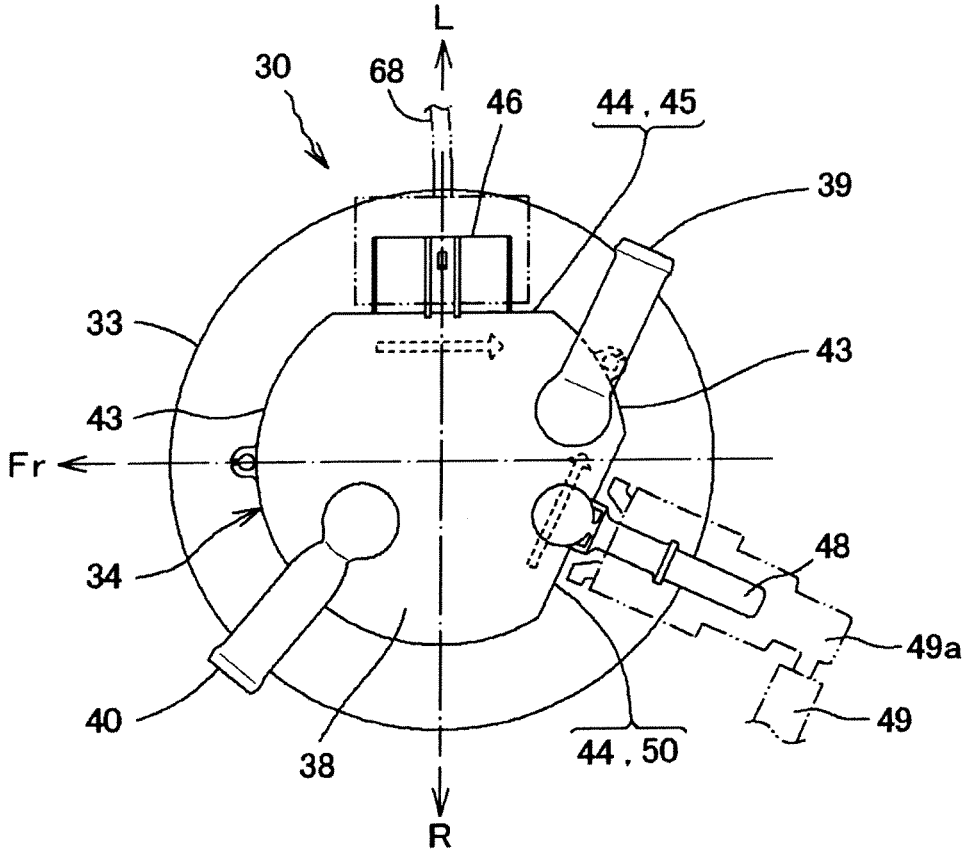
FIG. 5 is a bottom view of the fuel pump unit.
Figure 6:
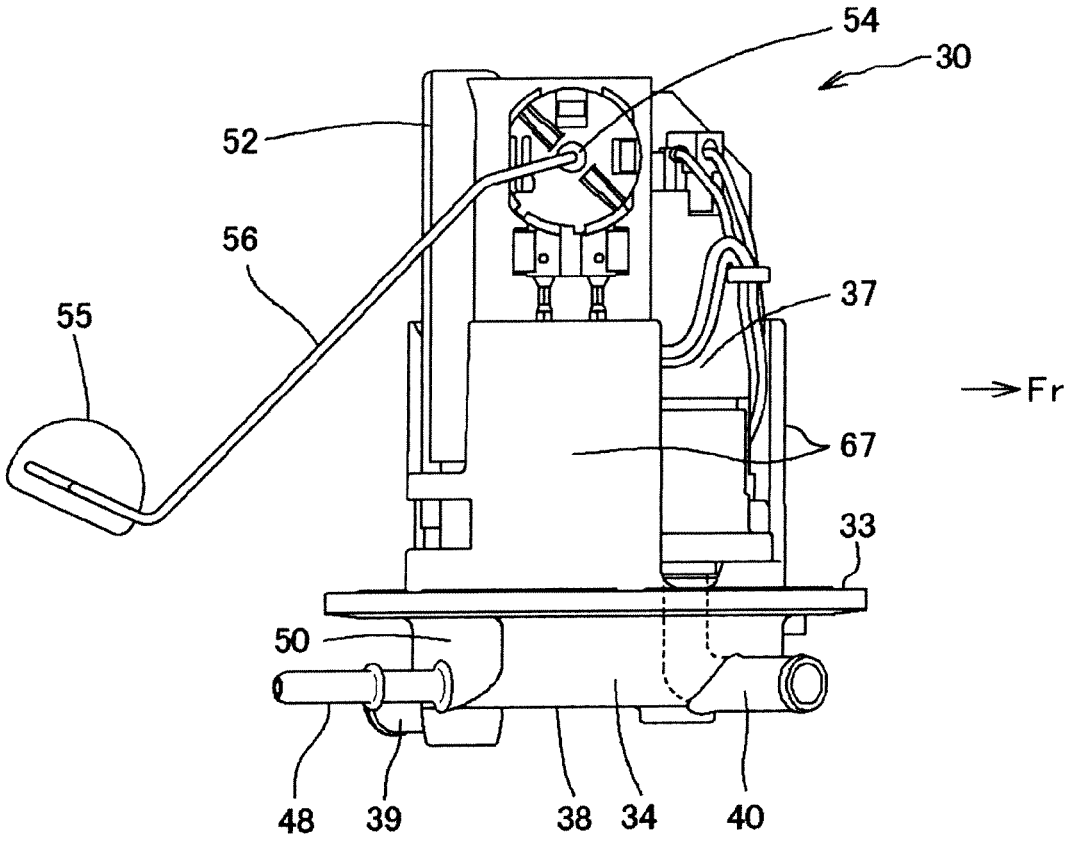
FIG. 6 is a right lateral view of the fuel pump unit, as viewed from arrow VI in FIG. 4.
Figure 7:
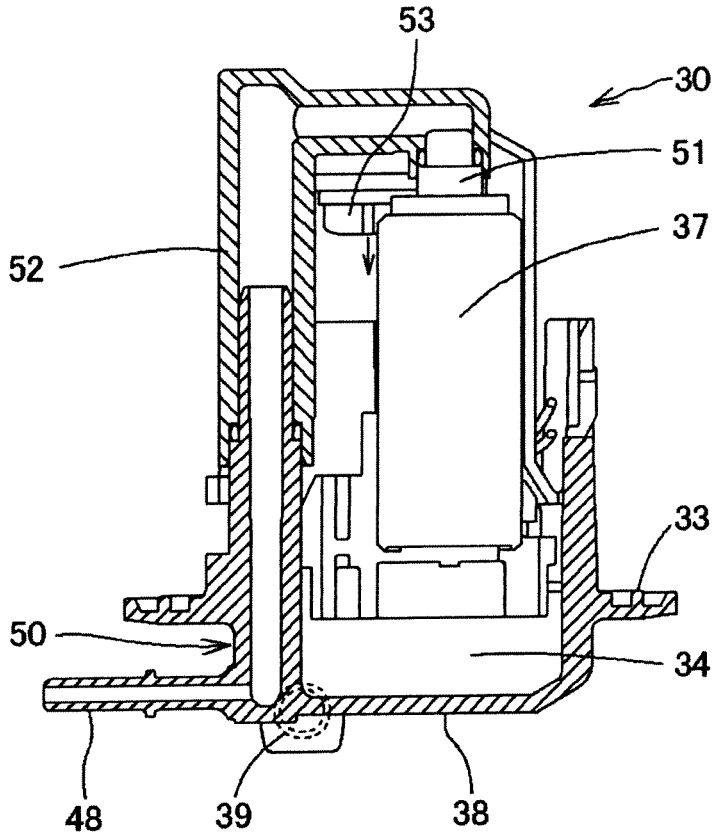
FIG. 7 is a cross-sectional view taken along line VII-VII in FIG. 4.

FIG. 4 is a plan view of the fuel pump unit 30. FIG. 5 is a bottom view of the fuel pump unit 30. FIG. 6 is a right lateral view of the fuel pump unit 30, as viewed from arrow VI in FIG. 4. FIG. 7 is a cross-sectional view of FIG. 4 as viewed from line VII-VII.

The fuel pump unit 30 is provided at its lower portion with a circular flange 33 protruding from the lateral surface. In this embodiment, this flange 33 is a portion that comes into contact with the circumferential portion of the pump unit insertion hole 31 (FIG. 3) in the lower surface of the tank bottom plate 25 when the fuel pump unit 30 is mounted. In FIGS. 6 and 7, a fuel temporary reservoir portion 34 is formed under the flange 33. The fuel temporary reservoir portion 34 is located at a position lower than the tank bottom plate 25. The fuel temporary reservoir portion 34 communicates with the inside of the fuel tank 19. The upper surface of the fuel temporary portion 34 is open. The fuel in the fuel tank 19 flows into the fuel temporary reservoir portion 34 from a cutout portion (FIG. 6) of a lateral wall 67 of the fuel pump unit 30.

In FIG. 5, a fuel sucking-out pipe 39 extending leftward rearward is provided integrally with the rear portion of a bottom wall 38 of the fuel temporary reservoir portion 34. A fuel suction pipe 40 is provided integrally with a front right side of the fuel temporary reservoir portion 34. As indicated with a broken line in FIG. 6, an inner end portion of the fuel suction pipe 40 is connected to the lower portion of a fuel pump 37. The fuel flowing into the fuel temporary reservoir portion 34 is sucked from the fuel sucking-out pipe 39 and sucked by the fuel pump 37 from the fuel suction pipe 40 via a fuel filter unit 41 and a filter pipe 42, described later.

Referring to FIG. 5, the lateral surface of the fuel temporary reservoir portion 34 installed below the attachment flange 33 is shaped such that two lateral-wall tubular portions 43 and two lateral-wall flat surface portions 44 are alternately combined with each other. A left lateral-wall flat surface portion 44 serves as a coupler-receiving surface 45 for electric wiring and is attached with a coupler 46. The coupler 46 is adapted to connect with an electric line 68 to supply electric power to the fuel pump 37 or to control the electric power.

A fuel discharge pipe 48 is installed on the right lateral-wall flat surface portion 44 in the rear portion of FIG. 5 integrally with the lateral wall of the fuel temporary reservoir portion 34. The fuel discharge pipe 48 is adapted to supply the fuel increased in pressure by the fuel pump 37 to a fuel injector 47 (FIG. 9) of the engine 10. The right lateral-wall flat surface portion 44 serves as a joint-receiving surface 50 spaced slightly apart from an end face of a joint 49*a* of a fuel supply hose 49 connected to the fuel discharge pipe 48.

Referring to FIG. 7, a discharge portion 51 is provided at an upper portion of the fuel pump 37. A discharge passage member 52 manufactured separately from the discharge portion 51 is coupled to the discharge portion 51. The discharge passage member 52 bends downward in mid-course and is connected to the fuel discharge pipe 48 located below the discharge passage member 52. The fuel discharge pipe 48 is connected to the fuel injector 47 (FIG. 9) of the engine via the fuel supply hose 49. A pressure regulating valve 53 is installed on the side of and continuously with the discharge portion 51. The pressure regulating valve 53 prevents the fuel supplied to the fuel injector 47 from having excess pressure, thereby supplying the fuel at a constant pressure. The fuel discharged from the pressure regulating valve 53 under the excess pressure is returned to the fuel temporary reservoir portion 34.

Referring to FIG. 6, a float 55 of a fuel level gauge is attached via a float arm 56 to a fuel level gauge turning shaft 54 located on an upper right-lateral surface of the fuel pump unit 30. Thus, the remaining amount of fuel can be seen.

Figure 8:
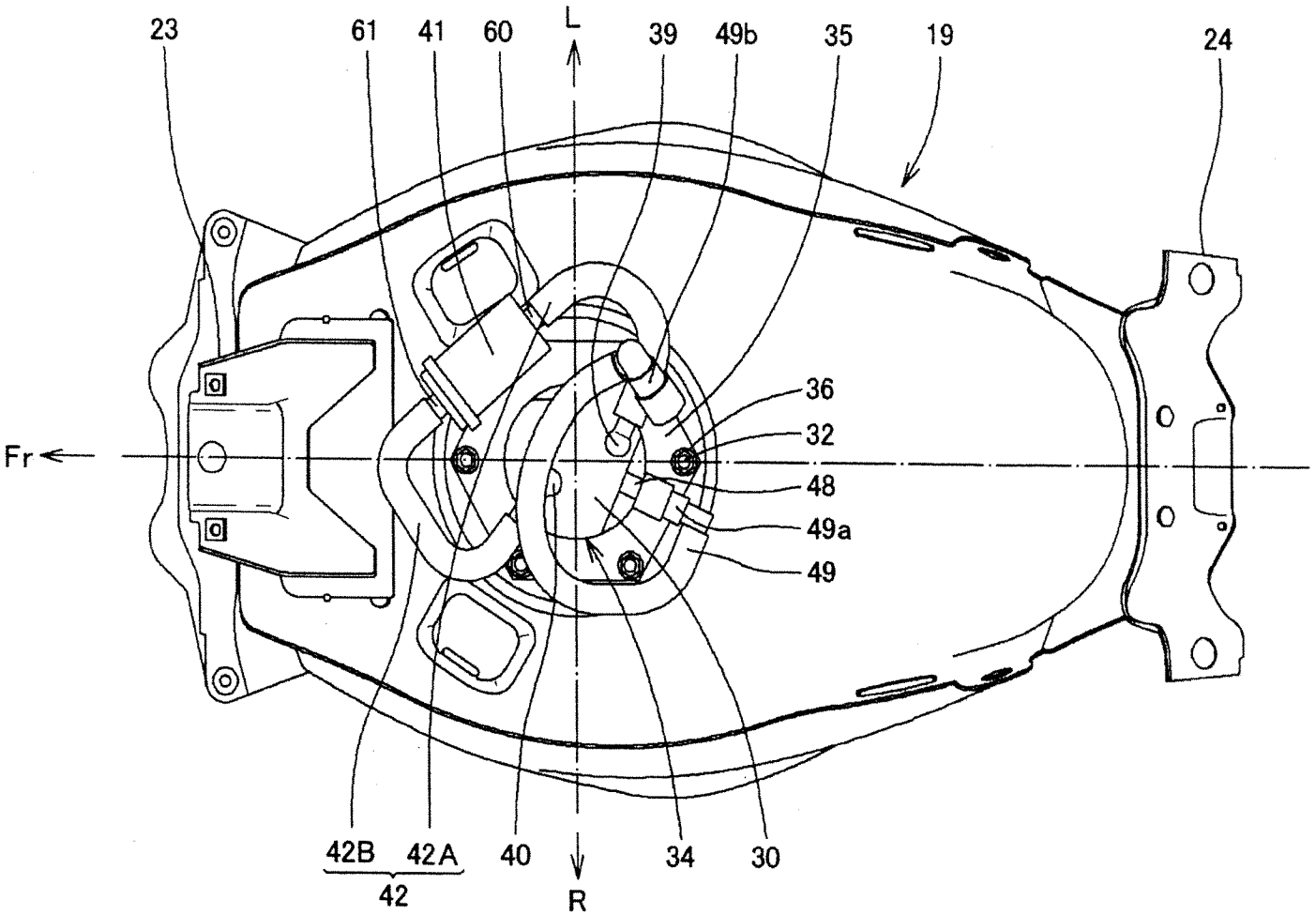
FIG. 8 is a bottom view of a fuel tank in a state where the fuel pump unit is mounted.

FIG. 8 is a bottom view of the fuel tank 19 in a state where the fuel pump unit 30 is mounted from the underside of the fuel tank 19. A hexagonal plate-like member 35 is used to mount the fuel pump unit 30 to the fuel pump unit insertion hole 31 in the lower surface of the fuel tank 19. In this example, the hexagonal plate-like member 35 is a hexagonal plate having an outer circumferential portion greater than the outer circumference of the flange 33 mentioned earlier. The hexagonal plate-like member 35 is provided at six corners with bolt insertion holes adapted to receive bolts 32 (FIG. 3) inserted therethrough. The hexagonal plate-like member 35 is provided at its center with a large-diameter hole adapted to receive the fuel temporary reservoir portion 34 inserted therethrough. The upper portion of the fuel pump unit 30 is inserted into the fuel tank 19 from the fuel pump unit insertion hole 31 (FIG. 3). The fuel temporary reservoir portion 34 is inserted through the large-diameter hole of the hexagonal plate-like member 35. The hexagonal plate-like member 35 is brought into contact with the lower surface of the flange 33 of the fuel pump unit 30. Nuts 36 are threadedly engaged with and tightened to the bolts 32 inserted through the bolt insertion holes. In this way, the fuel pump unit 30 is secured to the lower surface of the fuel tank 19.

Figure 9:
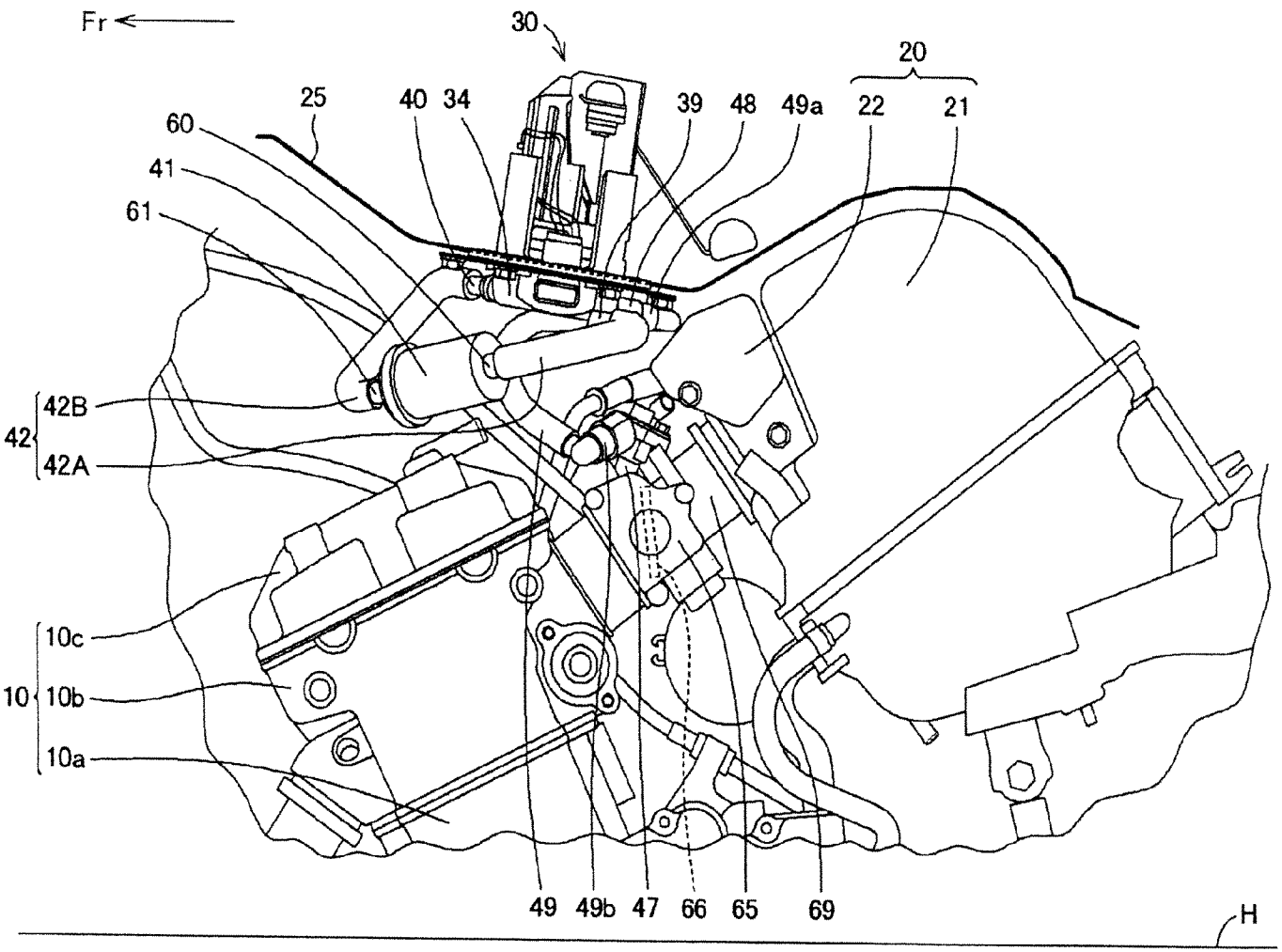
FIG. 9 is a left lateral view illustrating the fuel pump unit and a configuration below the fuel pump unit.

FIG. 9 is a left lateral view illustrating the fuel pump unit 30 and a configuration below the fuel pump unit 30 with the fuel tank 19 removed, in the posture taken when the motorcycle 2 is supported by the main stand 70. Symbol "H" denotes a horizontal plane. In FIGS. 8 and 9, the fuel filter unit 41 is installed below the fuel pump unit 30. The fuel filter unit 41 is supported by a support portion (not shown) extending from the hexagonal plate-like member 35. The fuel sucking-out pipe 39 and the fuel suction pipe 40 are connected to each other via the filter pipe 42 with the fuel filter unit 41 put in mid-course therebetween. The filter pipe 42 is composed of an upstream side filter pipe 42A and a downstream side filter pipe 42B. The fuel sucking-out pipe 39 and the fuel filter unit 41 are connected to each other via the upstream side filter pipe 42A. In addition, the fuel filter unit 41 and the fuel suction pipe 40 are connected to each other via the downstream side filter pipe 42B.

If the fuel pump 37 is driven, the fuel in the fuel temporary reservoir portion 34 is sucked into the fuel pump 37 via the fuel sucking-out pipe 39, the upstream side filter pipe 42A, the fuel filter unit 41, the downstream side filter pipe 42B and the fuel suction pipe 40 and discharged from the fuel discharge pipe 48.

In FIG. 9, the engine 10 includes a cylinder block 10*a*, a cylinder head 10*b*, and a cylinder head cover 10*c*. The air cleaner 21 and the resonator 22, which are the intake-system chamber 20, are disposed rearward of the fuel temporary reservoir chamber 34. A throttle body 65 is connected to the rear portion of the cylinder head 10*b*. The air going through the intake system chamber 20 is sucked into the throttle body 65 via a connecting tube 69. The throttle body 65 includes a throttle valve 66 and the fuel injector 47. Fuel is supplied from the fuel pump unit 30 to the fuel injector 47 via the fuel discharge pipe 48, the joint 49*a*, the fuel supply hose 49 and a connecting portion 49*b*. Such fuel is mixed with air going through the intake system chamber 20 and then the mixture is fed to the combustion chamber in the cylinder head 10*b*.

Figure 10:
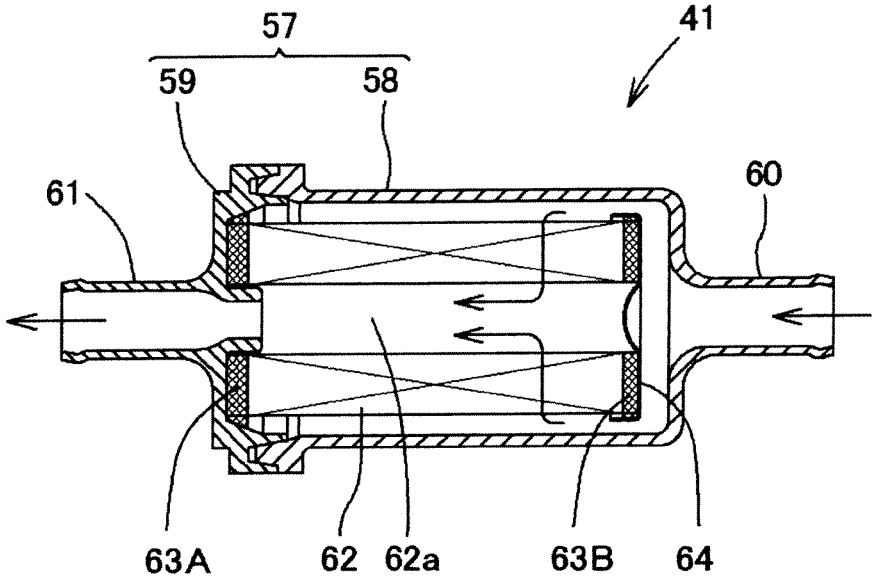
FIG. 10 is a cross-sectional view of the fuel filter unit.

FIG. 10 is a cross-sectional view of the fuel filter unit 41. A filter case 57 is composed of a tubular member 58 and a lid member 59. The tubular member 58 is provided with an inflow port 60 and the lid member 59 is provided with an outflow port 61. A filter element 62 provided with a central through-hole 62*a* is bonded at one end to the inner surface of the lid member 59 via an adhesive 63A. A circular plate-like member 64 is stuck to the other end of the filter element 62 via an adhesive 63B. The upstream side filter pipe 42A is coupled to the inflow port 60 and the downstream filter pipe 42B is coupled to the outflow port 61 (FIGS. 8 and 9). The fuel having flowed into the filter case 57 from the inflow port 60 flows into the outside of the filter element 62, is purified while flowing inward in the filter element 62, collecting into the central through-hole 62*a*, and flows out from the outflow port 61. The fuel flowing out from the outflow port 61 is sucked into the fuel pump 37 via the downstream side filter pipe 42B and the fuel suction pipe 40.

For a highly-volatile fuel, the fuel in the fuel filter unit 41 gives off fuel vapor during the parking of the vehicle. The fuel is supplied under its own weight from the fuel tank 19 to the fuel filter unit 41. If the inflow port 60 of the fuel filter unit 41 is blocked by vapor, therefore, the fuel cannot be fed.

In FIG. 9, the inflow port 60 of the fuel filter unit 41 is disposed at a position higher than the outflow port 61. In addition, the upstream side filter pipe 42A is arranged at a higher position as it goes toward the upstream side. This is because of the following reasons. During the stoppage in which the motorcycle 2 is supported by the main stand 70, fuel may not flow in the filter pipe 42. Even in such a case, the vapor occurring in the fuel filter unit 41 is allowed to move toward the inflow port 60 of the fuel filter unit 41. In addition, the vapor is allowed to return from the inflow port 60 to the fuel tank 19 via the upstream side filter pipe 42A. In this way, the vapor lock in the fuel filter unit 41 can be prevented without the provision of a vapor-return-dedicated gas-bleeding pipe, as has heretofore been installed, continuous with the lateral-surface upper portion of the filter case.

Figure 11:
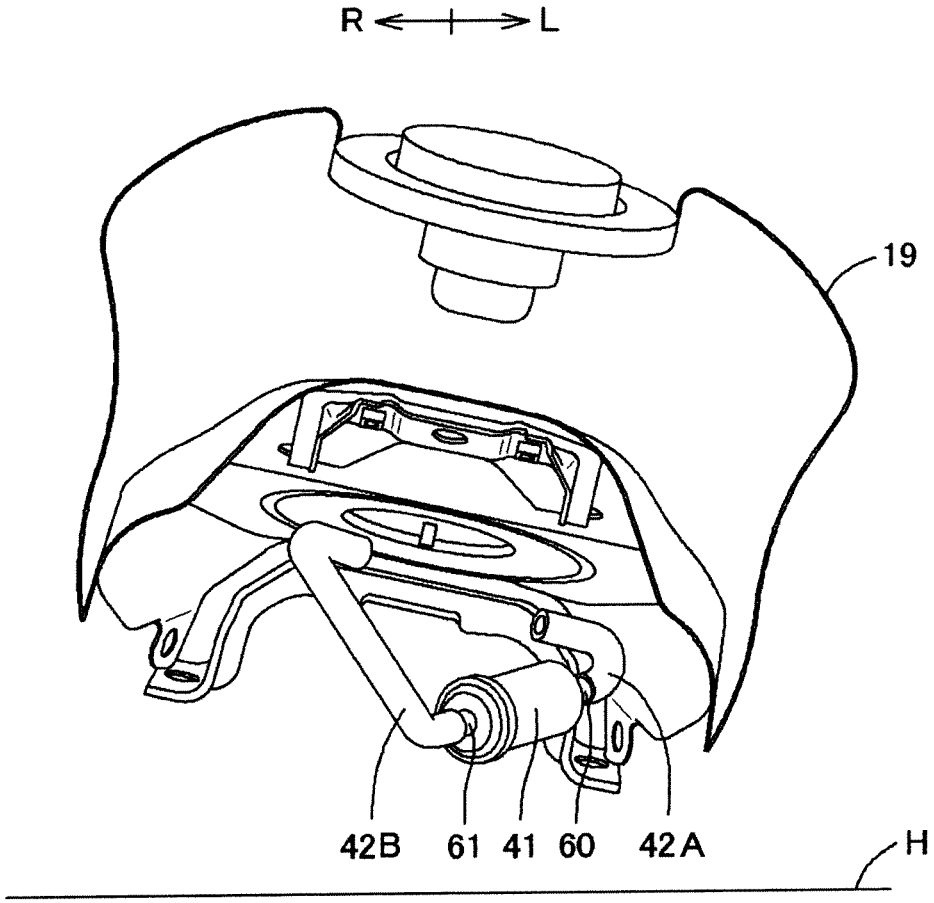
FIG. 11 is a horizontal-sectional front view of the fuel tank encountered when the vehicle is supported by the side stand.

FIG. 11 is a horizontal-sectional front view of the fuel tank 19 encountered when the motorcycle 2 is supported by the side stand 71. The pipes other than the upstream side filter pipe 42A and the downstream side filter pipe 42B are omitted in the figure. Symbol "H" denotes the horizontal plane. When the motorcycle 2 is stopped and supported by the side stand 71, the fuel tank 19 along with the motorcycle 2 is tilted leftward. Even in this state, the fuel filter unit 41 is attached to the vehicle body so that the inflow port 60 is located at a position higher than outflow port 61. In addition, the upstream side filter pipe 42A is arranged at a higher position as it goes toward the upstream side. Therefore, even when the vehicle body is tilted, the vapor return effect is continued. Thus, the vapor lock in the fuel filter unit 41 can be prevented.

As seen in FIG. 11 which is a front view of the fuel tank 19 encountered when the motorcycle is supported by the side stand 71, the upstream end of the upstream side filter pipe 42A is disposed on the same side as the side stand 71, i.e., on the left side. If fuel is small in amount, even when the motorcycle 2 is stopped and supported by the side stand 71 so that the vehicle body is tilted, the fuel easily flows into the upstream side filter pipe 42A. Thus, the fuel can be utilized effectively.

Even when the motorcycle 2 is stopped and is supported by any one of the main stand 70 and the side stand 71, the downstream side filter pipe 42B is configured to extend upward from the outflow port 61 of the fuel filter unit 41. In this way, the vapor occurring on the clean side (on the outflow port 61 side) can be easily bled toward the fuel pump 37.

As illustrated in FIG. 9, the fuel sucking-out pipe coupled to the upstream side filter pipe 42A is installed in the fuel temporary reservoir portion 34. Even when the motorcycle 2 is supported by any one of the main stand 70 and the side stand 71, the fuel sucking-out pipe 39 is located rearward of and below the fuel temporary reservoir portion 34 and also on the left side similar to the side stand 71. In this way, when the motorcycle 2 is stopped, the fuel sucking-out pipe 39 is constantly located at a low position in the fuel temporary reservoir portion 34. Thus, the fuel supply can be made smooth and vapor-bleeding can be made satisfactory.

Figure 12:
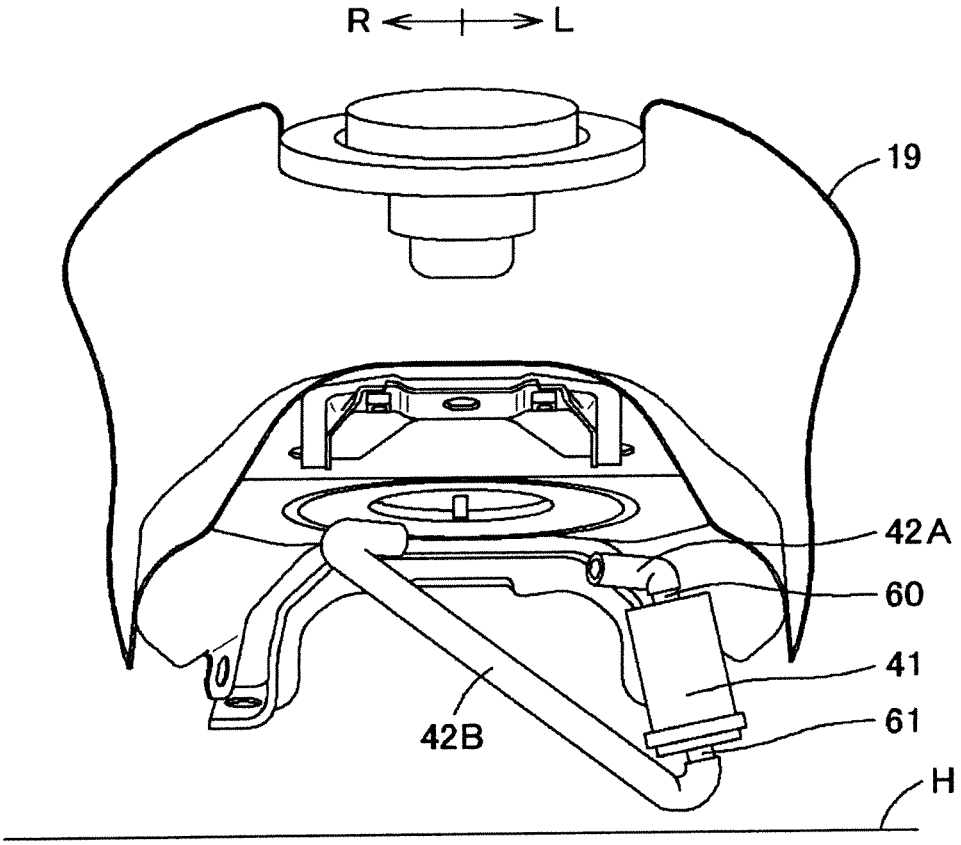
FIG. 12 is a horizontal-sectional view illustrating the vicinity of the fuel tank encountered when the vehicle is supported by a main stand, according to a second embodiment of the present embodiment.
Figure 13:
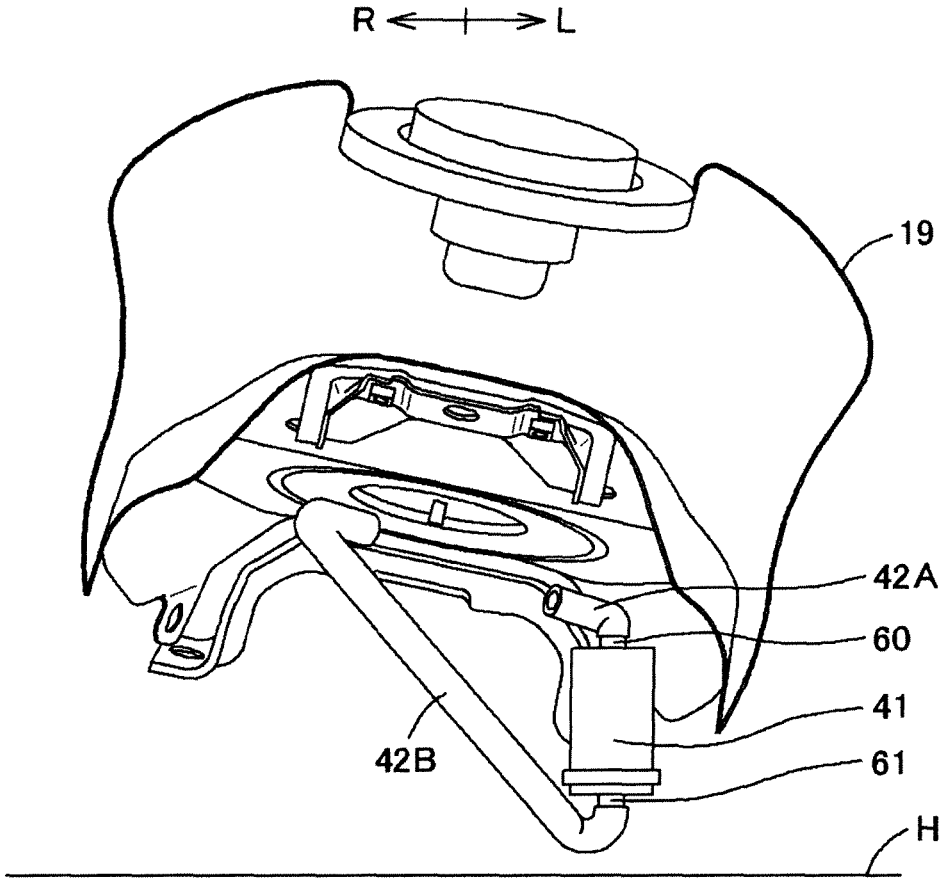
FIG. 13 is a transverse cross-sectional view illustrating the vicinity of the fuel tank encountered when the vehicle is supported by the side stand.

FIG. 12 is a horizontal-sectional front view illustrating the vicinity of the fuel tank 19 encountered when the motorcycle 2 is supported by the main stand 70, according to another embodiment of the present embodiment. The configuration of the fuel filter unit 41 is the same as that of the first embodiment. However, the characteristic of the second embodiment is that the fuel filter unit 41 is installed by modifying its posture as below. The inflow port 60 and the outflow port 61 are located on the upper side and the lower side, respectively, and the axis of the tubular fuel filter unit 41 extends in a generally vertical direction. FIG. 13 is a horizontal-sectional front view illustrating the vicinity of the fuel tank 19 in a state where the motorcycle 2 is supported by the side stand 71. The axis of the fuel filter unit 41 is vertical. With such configuration, it becomes easy for the vapor on the outflow port 61 side of the fuel filter unit 41 to flow backward and be bled toward the inflow port 60 side of the fuel filter unit 41. Thus, vapor-bleeding can be enabled further effectively.

Figure 14:
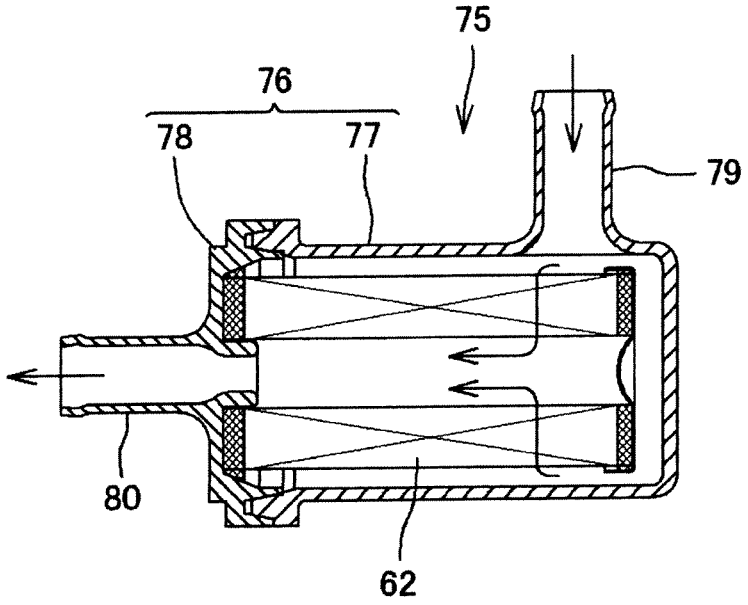
FIG. 14 is a cross-sectional view of a fuel filter unit according to a third embodiment of the present invention.

FIG. 14 is a cross-sectional view of a fuel filter unit 75 according to another embodiment of the present invention. A filter case 76 is composed of a tubular member 77 and a lid member 78. An inflow port 79 is provided at a lateral portion of the tubular member 77. An outflow port 80 is provided on the lid member 78 similarly to the first embodiment. The configuration and attachment structure of the filter element 62 are the same as those of the first embodiment.

Figure 15:
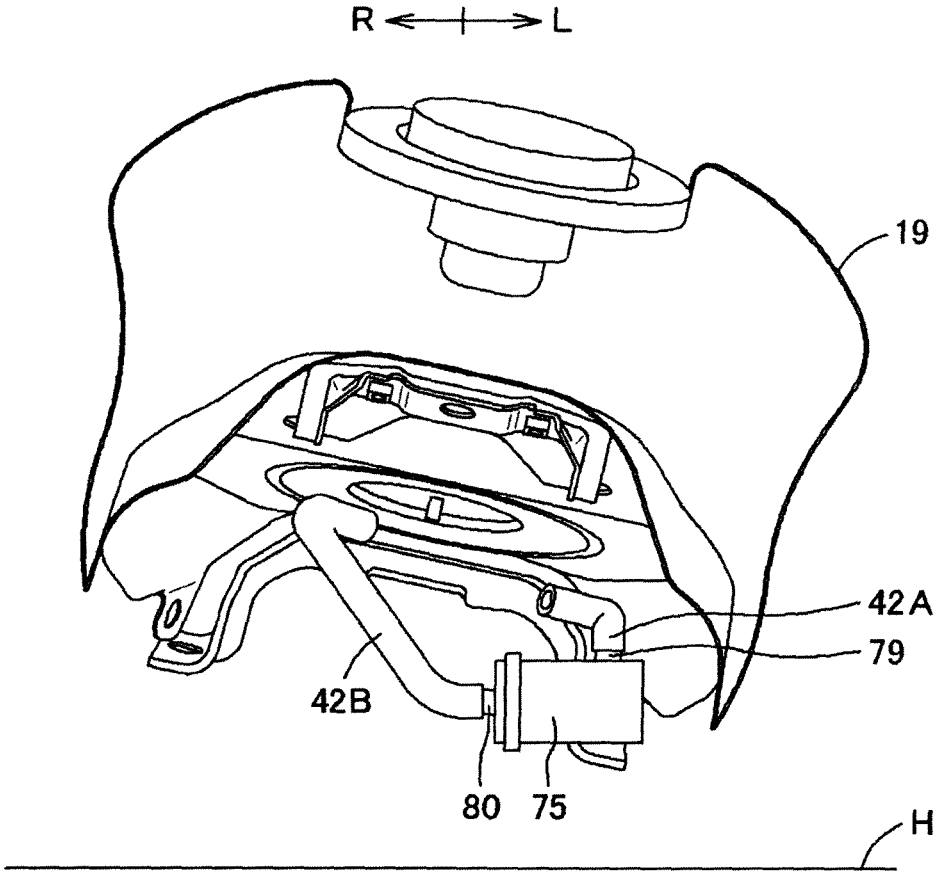
FIG. 15 is a horizontal-sectional front view illustrating the vicinity of the fuel tank encountered when the vehicle equipped with the fuel filter unit is supported by the side stand.

FIG. 15 is a horizontal-sectional front view illustrating the vicinity of the fuel tank 19 in the state where the motorcycle 2 equipped with the fuel filter unit 75 described above is supported by the side stand 71. The axis of the fuel filter unit 75 is generally horizontal and the fuel filter unit 75 is installed on the motorcycle 2 so that the inflow port 79 faces the upside. This can make satisfactory the vapor-bleeding performance on the inflow port 79 side and on the outflow port 80 side. This effect is the same as when the motorcycle 2 is supported by the main stand 70.

The motorcycle 2 in each of the embodiments can arbitrarily use gasoline, alcohol or a mixture of gasoline and alcohol as fuel. Fuel newly fed into the fuel tank 19 may be different in type and in alcohol concentration from the fuel remaining in the fuel tank 19. Even in such a case, each of the filter case 57, 76 functions as a sub-tank so that the new and old fuels are mixed with each other in the filter case 57, 76. Therefore, a variation in the alcohol concentration in the fuel fed to the fuel injector 47 of the engine 10 can be reduced. Thus, appropriate fuel injection control according to the proportion of gasoline to alcohol can be enabled to improve start-up performance and traveling performance. The fuel injection control described above is such that alcohol concentration in fuel is detected based on oxygen concentration in engine exhaust and control according to the alcohol concentration is exercised.

As described above in detail, the embodiments produce the following effects.

(1) In the upright state where the motorcycle 2 is supported by the main stand 70, the inflow port 60 of the fuel filter unit 41 is disposed at a position higher than the outflow port 61. In addition, the upstream side filter pipe 42A is arranged at a higher position as it goes toward the upstream side. Therefore, the vapor occurring in the fuel filter unit 41 is allowed to move toward the inflow port 60 of the fuel filter unit 41. In addition, the vapor is allowed to return to the fuel tank 19. Thus, vapor lock in the fuel filter unit 41 can be prevented.

(2) Also in the tilted state where the motorcycle 2 is supported by the side stand 71, the inflow port 60 of the fuel filter unit 41 is disposed at a position higher than the outflow port 61. In addition, the upstream side filter pipe 42A is arranged at a higher position as it goes toward the upstream side. Therefore, similar to the above item, vapor lock in the fuel filter unit 41 can be prevented.

(3) The upstream end of the upstream side filter pipe 42A is disposed on the same side as the side stand 71, i.e., on the left side. Even when fuel is small in amount and the motorcycle 2 is supported by the side stand 71, the fuel easily flows into the upstream side filter pipe 42A. Therefore, fuel can be utilized effectively.

(4) Even when the motorcycle is supported by any one of the main stand 70 and the side stand 71, the downstream side filter pipe 42B is disposed to extend upward from the outflow port 61 of the fuel filter unit 41. This can make it easy for the vapor occurring on the clean side (the outflow port 61 side) in the fuel filter unit 41 to be bled toward the fuel pump 37.

(5) Even when the motorcycle 2 is supported by any one of the main stand 70 and the side stand 71, the fuel sucking-out pipe 39 coupled to the upstream side filter pipe 42A is located rearward of and below the fuel temporary reservoir portion 34. In addition, the fuel sucking-out pipe 39 is located on the left side similarly to the side stand 71. Therefore, the fuel sucking-out pipe 39 is constantly at a low position in the fuel temporary reservoir portion 34. Thus, fuel supply can be made smooth and vapor-bleeding can be made satisfactory.

(6) In the second embodiment, the fuel filter unit 41 is installed on the motorcycle 2 such that the inflow port 60 and the outflow port 61 are located upward and downward, respectively, and the longitudinal direction of the fuel filter unit 41 is made vertical. Therefore, the vapor on the outflow port 61 side of the fuel filter unit 41 is allowed to flow back toward the inflow port 60 of the fuel filter unit 41 and can easily be bled. Thus, vapor-bleeding can be effectively enabled.

(7) In the fuel filter unit 75 of the third embodiment, the inflow port 79 is provided on the lateral portion of the tubular member 77 so as to face the upside. In addition, the outflow port 80 is provided on the lid member 78 similarly to the first embodiment. Therefore, air-bleeding performance on the inlet port 79 side and on the outlet port 80 side can be made satisfactory.

(8) The motorcycle 2 described above can use gasoline, alcohol or a mixture of gasoline and alcohol as fuel. Fuel newly fed into the fuel tank 19 may be different in type and in alcohol concentration from the fuel remaining in the fuel tank 19. Even in such a case, the filter case 57, 76 function as a sub-tank so that the new and old fuels are mixed with each other in the filter case 57, 76. Therefore, a variation in the alcohol concentration in the fuel fed to the fuel injector 47 of the engine 10 can be reduced. Thus, appropriate fuel injection control according to the proportion of gasoline to alcohol can be enabled.

DESCRIPTION OF REFERENCE SYMBOLS

1 . . . . Fuel supply device, 2 . . . . Motorcycle, 10 . . . Engine, 19 . . . . Fuel tank, 25 . . . . Tank bottom plate, 30 . . . . Fuel pump unit, 31 . . . Fuel pump unit insertion hole, 34 . . . . Fuel temporary reservoir portion, 37 . . . . Fuel pump, 39 . . . Fuel sucking-out pipe, 41 . . . Fuel filter unit, 42A . . . Upstream side filter pipe, 42B . . . Downstream side filter pipe, 47 . . . Fuel injector, 57 . . . Filter case, 60 . . . Inflow port, 61 . . . Outflow port, 62 . . . Filter element, 70 . . . Main stand, 71 . . . Side stand, 75 . . . Fuel filter unit, 76 . . . Filter case, 79 . . . Inflow port, 80 . . . . Outflow port.

The invention claimed is:

1. A fuel supply device for a vehicle, said fuel supply device comprising:

a fuel tank configured to be supported by a vehicle frame of a vehicle, and configured to store fuel therein;

a fuel pump unit configured to be mounted from below to block an opening of a bottom plate of the fuel tank;

a fuel pump disposed in the fuel tank to constitute part of the fuel pump unit, and configured to supply under pressure fuel to a fuel injector of an engine;

an upstream side filter pipe configured to disposed below the fuel tank and to communicate with an inside of the fuel tank;

a downstream side filter pipe connected to the fuel pump; and a fuel filter unit connected between the upstream side filter pipe and the downstream side filter pipe, and configured to filter fuel fed from the fuel tank to the fuel pump, wherein the fuel filter unit comprises a filter case, and wherein the filter case further comprising an inflow port on one end side thereof into which fuel fed from the fuel tank via the upstream side filter pipe flows, and on the other side with an outflow port configured to deliver fuel to the fuel pump via the downstream side filter pipe, the fuel filter unit further comprising, a filter element housed between the inflow port and the outflow port, wherein when the vehicle is in an upright state, the inflow port of the fuel filter unit is disposed at a position higher than the outflow port and the upstream side filter pipe is disposed at a higher position as the upstream side filter pipe goes toward the upstream side, wherein a fuel temporary reservoir portion communicating with the inside of the fuel tank is disposed at a lower portion of the fuel pump unit, a fuel sucking-out pipe connected with the upstream side filter pipe is disposed on the fuel temporary reservoir portion, and wherein the fuel sucking-out pipe is disposed at a position rearward of and below the fuel temporary reservoir portion.

2. The fuel supply device, according to claim 1, wherein the device is configured such that when the vehicle is stopped and supported by a side stand, the inflow port of the fuel filter unit is disposed at a position higher than the outflow port, and the upstream side filter pipe is disposed at a higher position as the upstream side filter pipe goes toward the upstream side.

3. The fuel supply device, according to claim 2, wherein an upstream end of the upstream side filter pipe is disposed on a same side as the side stand.

4. The fuel supply device according to claim 1, wherein when the vehicle is stopped and supported by one of the main stand and the side stand, the downstream side pipe is configured to extend upward from the outflow port of the fuel filter unit.

5. The fuel supply device according to claim 1, wherein when the vehicle is supported by one of the main stand and the side stand, the fuel sucking-out pipe is disposed at a position rearward of and below the fuel temporary reservoir portion and on a same side as the side stand.

6. The fuel supply device, according to claim 1, wherein the fuel filter unit is disposed with a longitudinal direction thereof having a vertical orientation so that the inflow port is upward and the outflow is downward.

7. The fuel supply device according to claim 1, wherein a lateral-surface upper portion of the fuel filter unit is formed with the inflow port and the fuel filter unit is formed with the outflow port on one end side.

8. The fuel supply device, according to claim 1, wherein the fuel for the vehicle is gasoline, alcohol or a mixture of gasoline and alcohol and fuel injection is controlled in accordance with a proportion of gasoline to alcohol.

9. A vehicle, comprising:

a vehicle frame;

a fuel tank supported by the vehicle frame, said fuel tank configured to store fuel therein;

a fuel pump unit mounted at a bottom section of the fuel tank, said fuel pump unit configured to block an opening of a bottom plate of the fuel tank;

a fuel pump disposed in the fuel tank, said fuel pump forming part of the fuel pump unit, said fuel pump configured to supply pressurized fuel to a fuel injector of an engine;

an upstream side filter pipe disposed below the fuel tank and in communication with an inside of the fuel tank;

a downstream side filter pipe connected to the fuel pipe;

a fuel filter unit disposed between the upstream side filter pipe and the downstream side filter pipe, said fuel filter unit configured to filter fuel fed from the fuel tank to the fuel pump, said fuel filter unit comprising a filter case, said filter case including an inflow port on one end side thereof into which fuel fed from the fuel tank via the upstream side filter pipe flows, said filter case further comprising an outflow port configured to deliver fuel from the fuel pump via the downstream side filter pipe, wherein the fuel filter unit further comprises a filter element housed between the inflow port and the outflow port, wherein when the vehicle is in an upright state, the inflow port of the fuel filter unit is disposed at a position higher than the outflow port, and wherein the upstream side filter pipe is disposed at a higher position as the upstream side filter pipe goes toward the upstream side, said vehicle further comprising a fuel temporary reservoir portion disposed at a lower portion of the fuel pump unit, and communicating with an inside of the fuel tank; and a fuel sucking-out pipe connected with the upstream side filter pipe disposed on the fuel temporary reservoir portion, wherein the fuel sucking-out pipe is disposed at a position rearward of and below the fuel temporary reservoir portion.

10. A vehicle according to claim 9, wherein the inflow port is configured such that when the vehicle is stopped and supported by the a side stand, the inflow port of the fuel filter unit is disposed at a position which is higher than the outflow port, and the upstream side filter pipe is disposed at a higher position as the upstream side filter pipe goes toward the upstream side.

11. The vehicle according to claim 10, wherein an upstream end of the upstream side filter pipe is disposed on a same side as the side stand.

12. The vehicle according to claim 9, wherein the vehicle is configured such that when the vehicle is stopped and supported by one of the main stand and the side stand, the downstream side pipe is configured to extend upward from the outflow port of the fuel filter unit.

13. The vehicle according to claim 9 when the vehicle is supported by one of the main stand and the side stand, the fuel sucking-out pipe is disposed at a position rearward of and below the fuel temporary reservoir portion and on a same side as the side stand.

14. The vehicle according to claim 9, wherein the fuel filter unit is disposed with a longitudinal direction thereof having a vertical orientation so that the inflow port is upward and the outflow is downward.

15. The vehicle according to claim 9, wherein a lateral surface upper portion of the fuel filter unit is integral with the inflow port and the fuel filter unit is integral with the outflow port on one end side.

16. The vehicle according to claim 9, wherein the vehicle is configured for gasoline fuel, alcohol fuel, or a fuel which is a mixture of gasoline and alcohol, wherein fuel injection is controlled in accordance with a proportion of gasoline to alcohol.

17. A fuel supply device for a vehicle, said fuel supply device comprising:

a fuel tank supported by the vehicle frame, said fuel tank configured to store fuel therein;

a fuel pump unit mounted at a bottom section of the fuel tank, said fuel pump unit configured to block an opening of a bottom plate of the fuel tank;

a fuel pump disposed in the fuel tank, said fuel pump forming part of the fuel pump unit, said fuel pump configured to supply pressurized fuel to a fuel injector of an engine;

an upstream side filter pipe disposed below the fuel tank and in communication with an inside of the fuel tank;

a downstream side filter pipe connected to the fuel pipe; and a fuel filter unit disposed between the upstream side filter pipe and the downstream side filter pipe, said fuel filter unit configured to filter fuel fed from the fuel tank to the fuel pump, said fuel filter unit comprising a filter case, said filter case including an inflow port on one end side thereof into which fuel fed from the fuel tank via the upstream side filter pipe flows, said filter case further comprising an outflow port configured to deliver fuel from the fuel pump via the downstream side filter pipe, wherein the fuel filter unit further comprises a filter element housed between the inflow port and the outflow port, wherein when the vehicle is in an upright state, the inflow port of the fuel filter unit is disposed at a position higher than the outflow port, and wherein the upstream side filter pipe is disposed at a higher position as the upstream side filter pipe goes toward the upstream side wherein a fuel temporary reservoir portion communicating with the inside of the fuel tank is disposed at a lower portion of the fuel pump unit, a fuel sucking-out pipe connected with the upstream side filter pipe is disposed on the fuel temporary reservoir portion wherein the fuel filter unit is disposed at between the engine and the fuel tank, wherein a fuel suction pipe is disposed on the fuel pump unit, wherein the fuel sucking-out pipe and the fuel suction pipe are disposed on opposite sides of each, and wherein the upstream side filter pipe and the downstream side filter pipe connected between the fuel sucking-out pipe and the fuel sucking pipe in the shape of a distortion loop.

18. The fuel supply device according to claim 1, wherein a fuel supply hose is configured to extend downward from the upstream side filter pipe.

19. The vehicle according to claim 9, wherein a fuel supply hose is configured to extend downward from the upstream side filter pipe.

* * * * *